US011234083B2

(12) United States Patent
Collado Bonet

(10) Patent No.: US 11,234,083 B2
(45) Date of Patent: Jan. 25, 2022

(54) FLEXIBLE ADAPTIVE HEARING AID

(71) Applicant: Jose Collado Bonet, El Plantio (ES)

(72) Inventor: Jose Collado Bonet, El Plantio (ES)

( * ) Notice: Subject to any disclaimer, the term of this patent is extended or adjusted under 35 U.S.C. 154(b) by 0 days.

(21) Appl. No.: 16/782,080

(22) Filed: Feb. 5, 2020

(65) Prior Publication Data

US 2020/0260193 A1 Aug. 13, 2020

(30) Foreign Application Priority Data

Feb. 8, 2019 (EP) ..... 19382090

(51) Int. Cl.
*H04R 25/02* (2006.01)
*H04R 1/10* (2006.01)
*H04R 25/00* (2006.01)

(52) U.S. Cl.
CPC ..... *H04R 25/02* (2013.01); *H04R 1/1016* (2013.01); *H04R 25/405* (2013.01); *H04R 25/43* (2013.01); *H04R 25/60* (2013.01); *H04R 2225/023* (2013.01); *H04R 2225/0213* (2019.05)

(58) Field of Classification Search
CPC ..... H04R 1/1016; H04R 25/60; H04R 25/65; H04R 25/652; H04R 25/656; H04R 2225/77; H04R 2225/023
See application file for complete search history.

(56) References Cited

U.S. PATENT DOCUMENTS 5,887,070 A 3/1999 Iseberg
8,770,338 B1 * 7/2014 Duncan ..... A61F 11/08 181/135
2009/0034775 A1 2/2009 Burton
2017/0094386 A1 * 3/2017 Trainer ..... G10K 11/17873

FOREIGN PATENT DOCUMENTS

WO 93/25053 A1 12/1993

OTHER PUBLICATIONS

European Patent Office Search; Munich; dated Jul. 17, 2019.

* cited by examiner

*Primary Examiner* — Mark Fischer
(74) *Attorney, Agent, or Firm* — Patshegen IP LLC; Moshe Pinchas

(57) ABSTRACT

The invention relates to a flexible adaptive hearing aid characterized by comprising: a part made of rigid material (1) which will contain the electronic circuit of the hearing aid, and a part made of flexible adaptive material (2) which will have at least one annular flange (3) which will improve the fit between the assembly and the internal auditory canal of the user. The part made of flexible material will cover at least a portion (4) of the surface of the part of rigid material. It will additionally have a cover to assure assembly tightness.

1 Claim, 3 Drawing Sheets

FLEXIBLE ADAPTIVE HEARING AID

TECHNICAL FIELD

The present invention corresponds to the sector of electronic apparatus for medical purposes, more specifically to the sector of electronic sound amplification devices to improve communication.

PRIOR ART

Today in the aforementioned sector, there are a number of electronic sound amplification devices to allow improved communication of the user.

These apparatus commonly receive sound through a microphone, which converts the sound waves into electrical signals, such that the amplifier increases the volume of said signals and sends the sounds to the ear through a loudspeaker.

The development of technology today has allowed for the integration of small-sized sound amplifiers, which offers significant benefits to auditory perception and the quality of life of the users, who in turn benefit from the small size as it helps to maintain discretion and appearance.

The arrival of digital technology has allowed for the emergence of a number of advantages as regards the operation thereof, with automatic adjustments of sound levels required by the user. Through a precise adaptation to the hearing loss of the user using a computer, it offers high fidelity sound quality.

Different types can be found on the market, such as in-the-ear types (which fit in the outer ear), behind-the-ear types (placed behind the ear, connected to a plastic ear mold located inside the outer ear) and completely-in-canal types (housed inside the ear canal).

This last type is the most beneficial for the user both on a sound quality level and on an aesthetic level since they are concealed inside the actual ear canal.

However, fitting them and taking them out can be complicated, often being more of a discomfort than a solution for the user. They may also cause uncomfortable pain or rubbing.

Additionally, given their poor fit, they may easily fall out and get lost during use in the event of a sudden movement, which would involve a high cost to replace it.

The present invention therefore addresses the current problems with completely-in-canal hearing aids, which cause user discomfort, caused by the poor fit and placement thereof.

Examples of current inventions belonging to the mentioned technical field are listed below:

- ES2151592T3 "Prótesis auditiva interna de obturación flexible"(In-the-ear hearing aid with flexible seal)
- ES2558084T3"Auricular mejorado" (Improved earpiece)
- ES2392812T3"Audífono" (Ear cup)
- ES2426336T3"Dispositivo expandible intraauricular" (Expandable in-ear device)
- ES2182424T3 "Un aparato de ayuda auditiva" (Listening assistance device)
- ES2380132T3 "Audífono mejorado de acción directa en el oído medio y procedimiento de instalación relacionado" (Middle ear direct action improved hearing aid and related installation method)

SUMMARY OF THE INVENTION

The technical problem to be solved by the present invention is to achieve a removable completely-in-canal hearing aid with a fit once it is placed which allows the user to wear it for long periods of time without feeling any discomfort. Furthermore, it prevents the possibility of losing the device.

Additionally, the assembly is sub-divided into two different parts: a part made of a more rigid material which will be placed in the interior of the hearing aid, and a part made of a more flexible material, which will be fixed on the outside thereof. Furthermore, it will have a cover so that the device is completely leak-tight.

On one hand, the part made of rigid material will be in charge of containing the electronic circuit in charge of amplifying the sound, from the receiving microphone to the emitting loudspeaker, managing sound quality and clarity and aiding in user communication.

On the other hand, the part made of flexible material will cover at least part of the surface of rigid material, with the function of perfectly fitting it in the inner ear of the user, assuring minimum tolerances which will assure precise coupling.

This has two clear advantages. On one hand, it assures there will be no unwanted movements of the hearing aid with respect to the inner ear of the user, causing poor sensations, assuring a perfect hold and preventing it from coming out. On the other hand, since it is a highly adaptable flexible material, it assures that unwanted rubbing which may hurt the user does not take place. It thereby prevents annoying sound or noise interference from occurring due to acoustic coupling since the device does not come out.

Since it is made up of two clearly distinguished parts, simple substitution of the flexible part is possible. This assures durability of the assembly, since it allows replacing the outer part when it is subjected to wear due to use.

Since the part containing the electronic circuit represents the higher cost, a long-lasting low-cost hearing aid is assured.

To assure system adaptability, the outer part will have at least one ring-shaped flange, surrounding the entire assembly. The number of flanges used is variable, depending on user requirements, and it may have as many as needed for use to be as comfortable as possible.

Based on this, the present invention provides a hearing aid made up of two different replaceable parts which will allow the user to use it without any type of discomfort, assuring that the fit between the outer part of the assembly and the internal auditory canal is perfect, preventing unnecessary movements and rubbing, while at the same time helping to keep the sound undistorted.

Furthermore, since the part flexible can be readily changed, the system represents significant savings, where the outer part can be replaced over time and the electronic circuit representing a higher cost for the user is conserved.

The description and the following claims do not seek to exclude other technical features, components, or steps. For those skilled in the art, other objects, advantages and features of the invention will become apparent in part from the description and in part from the use of the invention. The following examples and drawings are provided by way of illustration and do not intend to limit the present invention.

BRIEF DESCRIPTION OF THE DRAWINGS

To complement the description being made and for the purpose of helping to better understand the features of the invention, a set of drawings is attached as an integral part of said description in which the following is depicted with an illustrative and non-limiting character.

BEST WAY TO CARRY OUT THE INVENTION

Based on the attached drawings, a preferred configuration of the invention is described below.

Figure 1:
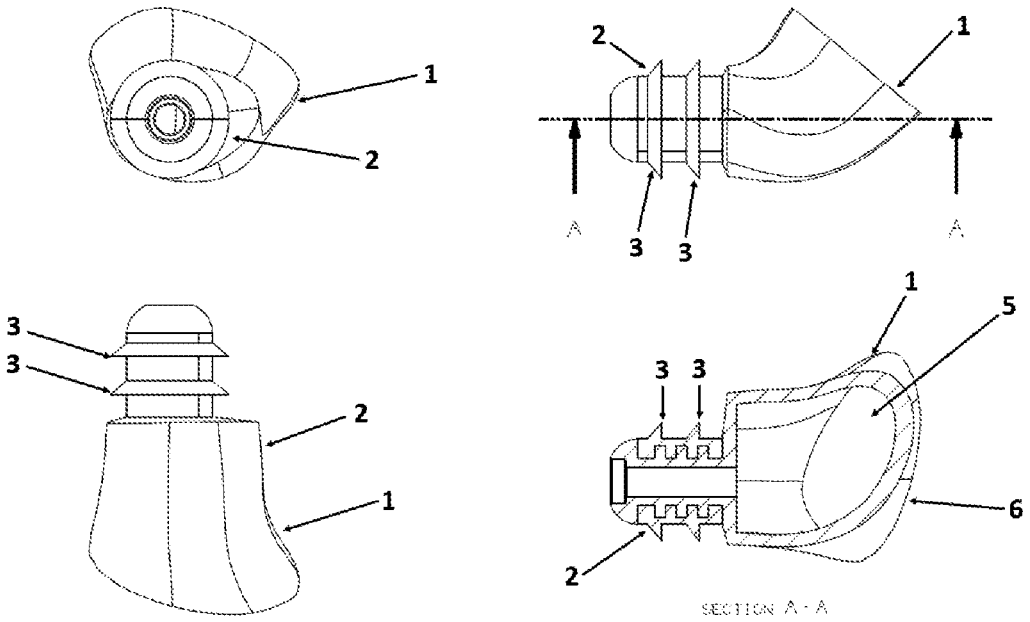
FIG. 1 shows general views of the hearing aid.

More specifically, the object of the present specification is characterized by comprising: a part made of rigid material (1) which will contain the electronic circuit of the hearing aid, and a part made of flexible adaptive material (2) which will have at least one annular flange (3) which will improve the fit between the assembly and the internal auditory canal of the user. The part made of flexible material will cover at least a portion (4) of the surface of the part of rigid material. It will additionally have a cover to assure assembly tightness. An example of the hearing aid can be seen in FIG. 1.

Figure 2:
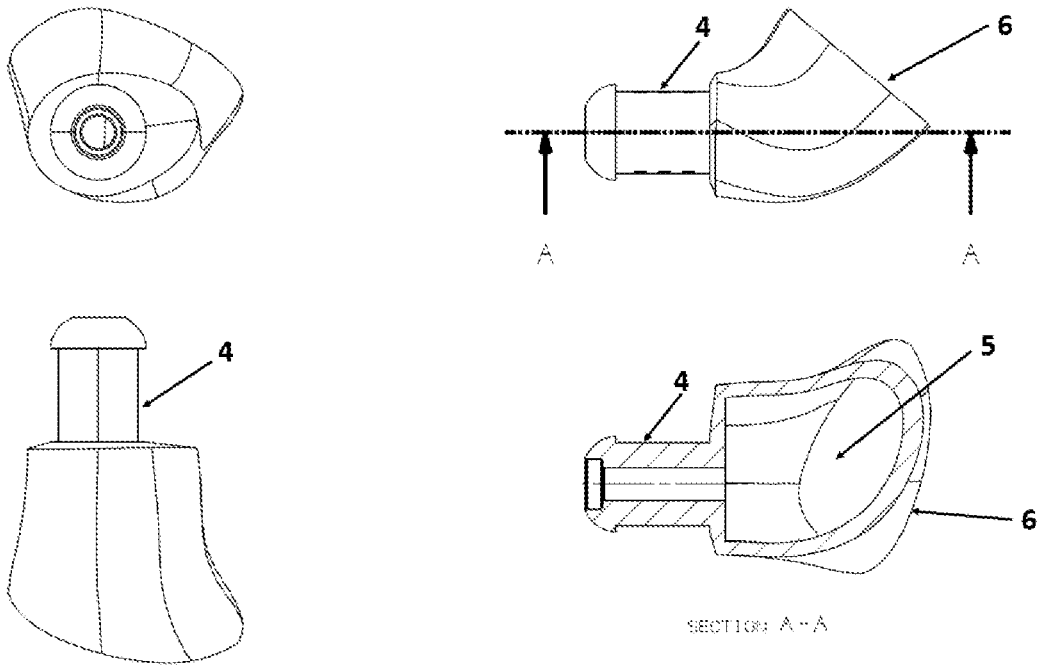
FIG. 2 shows detail views of the part made of rigid material.
Figure 3:
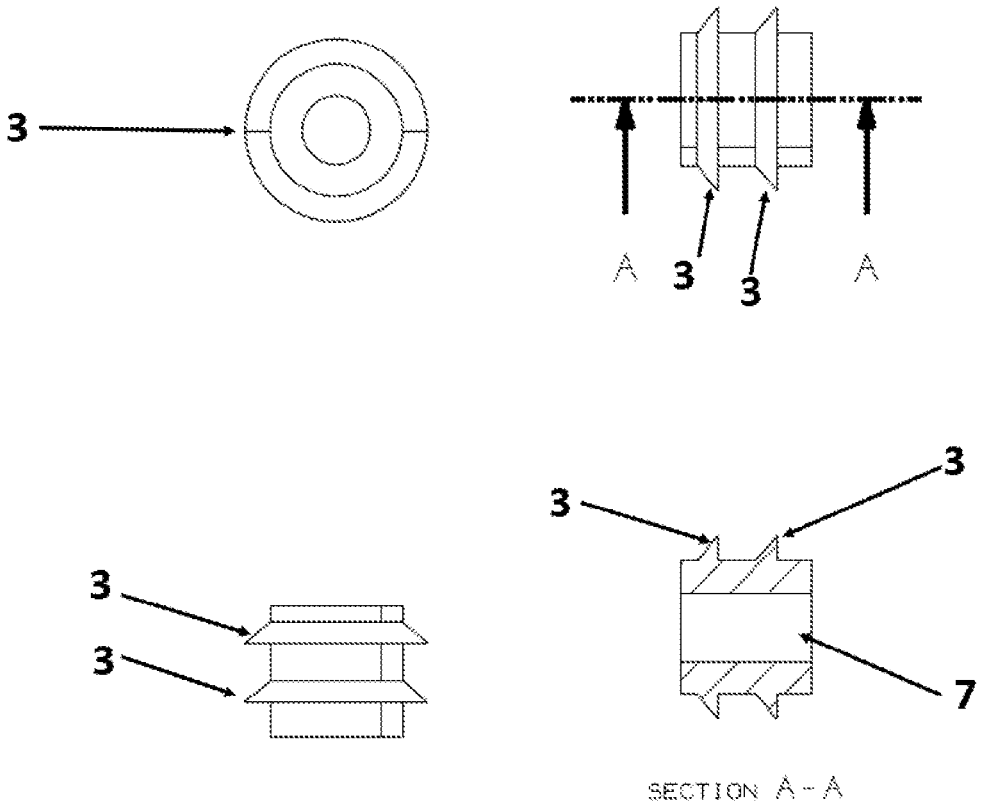
FIG. 3 shows detail views of the part made of flexible material.

The part made of rigid material (1) will be hollow to enable housing in its interior (5) the electronic circuit in charge of amplifying the sound reaching the microphone, emitting it by means of the built-in loudspeaker. Furthermore, it will have a cover to assure that the assembly is leak-tight and that the electronic circuit cannot be damaged by external or ambient conditions, placed at the beginning of the assembly (6). A detail of the rigid part of the hearing aid can be seen in FIG. 2.

This part will contain a recess where the part made of flexible material will be placed covering a portion of the surface (4).

The part made of adaptive flexible material (2) will be annular-shaped to enable housing in its interior (7), at least a portion of the aforementioned part, such that it will be in charge of assuring a perfect fit between the entire assembly and the auditory canal of the user.

To that end, it will have at least one hook-shaped flange (3) that will facilitate the introduction of the hearing aid into the inner ear canal and assure the contact and fit between same, preventing any type of play.

The flexible part (2) may be disassembled with respect to the rigid part (1), such that it allows the easy substitution in the event of wear or hardening, assuring high system durability.

This hearing aid may be adapted to any type of user, since both the number of flanges and the entire shape of the soft part may be customized to suit the needs of each case. The sound is therefore not altered and no annoying noises are produced.

INDUSTRIAL APPLICATION

The industrial application of the invention is clear, as it allows obtaining a hearing aid with a high durability because the parts forming it can be changed. It assures complete system functionality, assuring full comfort for the user. It also prevents problems with unwanted movements or distorted sounds, providing a perfect fit which eliminates any play that may arise, stabilizing hearing.

The invention claimed is:

1. A flexible adaptive hearing aid, comprising:

at least one rigid portion defining a hollow body configured to house an electronic circuit, a cover placed on a first end of the housing, and a channel coupled to a second end of the housing and being configured for inserting into an ear canal; and a flexible portion having a cylindrical-shape configured to be removably mounted over an outer surface of said channel;

wherein the flexible portion includes a plurality of annular hook-shaped flanges configured to engage an inner surface of the ear canal, each one of said annular hook-shaped flanges protrudes outwardly from said flexible portion and having an identical outer diameter; and wherein said channel defines a recess on said outer surface, and wherein said flexible portion is configured to entirely fit in said recess.

* * * * *